US005132659A

United States Patent [19]

Kuo

[11] Patent Number: 5,132,659

[45] Date of Patent: Jul. 21, 1992

[54] FLASHING LIGHT SIREN ALARM

[76] Inventor: Ching L. Kuo, c/o 180 - 11180 Voyuageur Way, Richmond, British Columbia, Canada, V6X 3N8

[21] Appl. No.: 547,860

[22] Filed: Jul. 3, 1990

[51] Int. Cl.[5] ..... G08B 27/00

[52] U.S. Cl. ..... 340/326; 340/384 R; 340/384 E; 340/474; 340/693; 340/321; 340/331; 340/815.21

[58] Field of Search ..... 340/326, 384 E, 384 R, 340/474, 692, 693, 691, 321, 331, 815.21, 815.22

[56] References Cited

U.S. PATENT DOCUMENTS 2,172,413 9/1939 Scott ..... 340/474
3,624,635 11/1971 Less ..... 340/326
4,241,332 12/1980 Farque ..... 340/326
4,559,517 12/1985 Rahn ..... 340/326
4,904,982 2/1990 Lieb et al. ..... 340/326

*Primary Examiner*—Donnie L. Crosland
*Attorney, Agent, or Firm*—Baker, Maxham, Jester & Meador

[57] ABSTRACT

A novel flashing light siren alarm which, when activated, provides a bright flashing strobe light and loud siren sound which attract attention. A flashing light siren and sound alarm which includes (a) a light emitting apparatus; (b) a sound emitting apparatus; (c) a battery adapted to power the light emitting apparatus and the sound emitting apparatus; and (d) a causing which carries the light and sound emitting apparatus, and the battery.

8 Claims, 4 Drawing Sheets

FLASHING LIGHT SIREN ALARM

FIELD OF THE INVENTION

This invention pertains to a novel flashing light and sound siren alarm which, when activated, provides a bright flashing strobe light and loud siren sound which attract attention.

BACKGROUND OF THE INVENTION

According to usual safety and security practice, warning strobe lights and sirens alarms are widely used in protecting construction sites, warehouses, institution buildings, police, military and special purpose vehicles against trespassers and intruders.

Many commercially available strobe light alarm systems are heavy, expensive and not readily portable. Some siren alarm systems rely solely on a loud piercing siren sound to generate an alarm.

There is available in the market place, a Radio Shack flashing light sound alarm device but it has sound holes in the bottom and the sound is smothered when the device is set down on the ground or a solid surface.

SUMMARY OF THE INVENTION

The invention pertains to a flashing light siren and sound alarm which comprises of a light emitting means; a sound emitting means; a sound reflecting means proximate to the sound emitting means adapted to disperse the sound emitted by the sound emitting means laterally and radially through 360° ; a battery adapted to power the light emitting means and the sound emitting means; and a casing which carries the light and sound emitting means, and the battery, the casing having a plurality of sound passing ports distributed 360° around the side periphery of the casing. The sound reflecting means can be a convex surface which reflects the sound emitted by the sound emitting means radially through the sound passing ports. The casing of the alarm can comprise three sections, an upper cup-like section which encloses the light emitting means, a cup-like mid-section which houses the sound emitting means, and a cup-like lower section which houses the sound reflecting means, the three sections being releasably connected together. The plurality of sound passing ports can be spacially distributed around the circumference of the mid-section of the casing. The sound emitting means can be a loud-speaker which is positioned at the base of the mid-section and emits sound in a downwardly direction. The sound reflecting means can also be positioned at the top of the lower section, with its convex surface facing upwardly to face the underside of the loud-speaker when the lower section and mid-section are connected together. The sound passing ports in the lower section can be distributed laterally around the periphery of the convex sound reflecting means.

The alarm is equipped with a DC electric power source which by actuation with an on-off switch means, powers an oscillator which in series drives and pulsates the light emitting means. The DC power source can activate in series first and second oscillating means which drive the sound emitting means, the first oscillating means comprising a circuit of at least one resistor, at least one capacitor and at least one transistor, which co-operate to produce an oscillating signal, and the second oscillating means comprising a circuit of at least one resistor, at least one capacitor and at least one transistor which co-operate to produce an output which drives the sound emitting means. The output of the power source can pass through a transformer, at least one resistor, and at least one transistor, and a capacitor which builds up voltage to a level where it discharges and activates the light emitting means and the output of the capacitor can also be connected to a pair of trigger electrodes, which cause the light emitting means to flash.

BRIEF DESCRIPTION OF THE DRAWINGS

In drawings which illustrate specific embodiments of the invention, but which should not be construed as restricting the spirit or scope of the invention in any way.

DETAILED DESCRIPTION OF THE PREFERRED EMBODIMENT

This invention is a combined strobe light siren alarm device that is portable, very flexible to install and achieves a high degree of warning activity by the use of a flashing strobe light and a unique loud siren sound dispersion system.

This device consists of three detachable sections, an upper strobe light and lens assembly, a mid-section that has slotted sidewalls for lateral sound emission and contains part of the electronic circuit and a siren speaker and a bottom section that contains a radial sound reflector and the remainder of the electronic circuit. These sections are connected together into a single assembly by screw threads. A bracket which attaches to the bottom section permits the whole assembly to be fastened to some surface at any angle. The siren sound is reflected by a reflector and is distributed evenly in all the directions through vertical mid-slot openings located around the perimeter of the mid-section.

Figure 1:
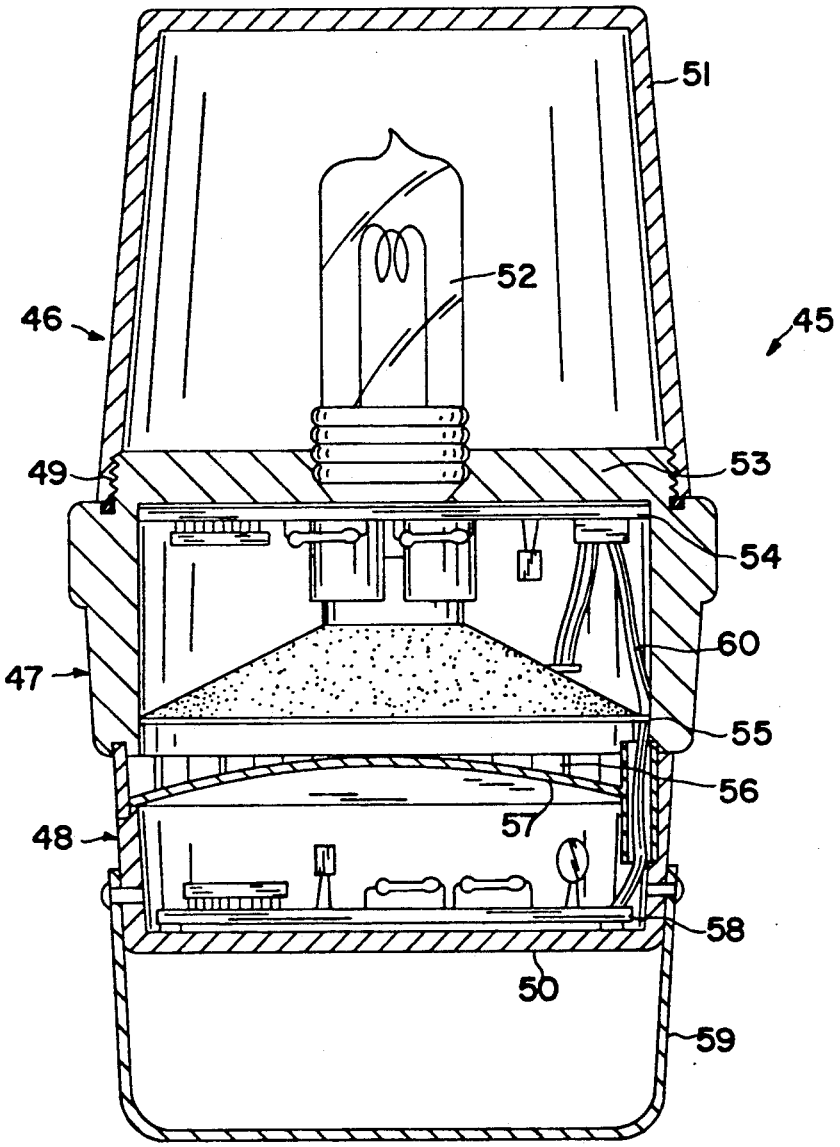
FIG. 1 depicts a cut-away frontal view of the flashing light, sound alarm.

Referring to the drawings, and FIG. 1 in particular, which illustrates a frontal cut-away view of the alarm 45, the alarm 45 is constructed of three basic detachable sections, an cup-like upper section 46 (which is a lens cover 51), a cup-like mid-section 47, and a cup-like bottom section 48. A strobe light tube 52 is electrically attached to the center of the top surface 53 of the mid section housing 47. The tube 52 is covered by a transparent colored or clear lens cover 51 that is screwed onto the top of mid-section housing 53 by threads 49.

The upper surface 57 of the bottom section 48 is an upwardly convex surface which acts as a lateral radial sound reflector. This convex surface 57 has positioned around its periphery in the upper walls of the bottom section 48 a ring of vertical "pillars" 56 which provide a 360 degree sound distribution capability through vertical slots between the pillars. The loud-speaker 55 and part of the electronic circuit 54 supporting the speaker are housed inside the upper section 46 underneath the top surface of mid-section housing 47. The bottom section 48 is attached to the underside of the mid-section 47 so that the loud-speaker 55 is immediately above the convex reflector 57. The part of the circuit 58 which drives the strobe light 52 is housed in the bottom section 48 and is connected to circuit 54 by wires 60. The operation of the strobe light 52 and the siren with speaker 55 is controlled by this combined circuit. In this manner, most of the interior space enclosed by the upper, mid and lower sections 46, 47 and 48 is utilized to house all the components to achieve a compact design.

In conventional siren warning devices, the speaker is usually mounted at the top or bottom of the device. If it is mounted at the bottom (facing downward), the sound distribution is greatly impaired when the device is set on a solid surface. Also, the sound tends to be dispersed downwardly rather than radially outwardly through a 360° pattern. If the speaker is mounted above, (facing upward) then the speaker and sound transmitting cover are subjected by means of the sound ports to the degrading effect of natural elements such as rain, water and dirt, when exposed outdoors.

With applicant's strobe light warning siren design, the speaker is mounted immediately below the strobe light (not at the bottom) and faces downward. It is therefore not exposed to the damaging effects of rain, water and dirt. With the presence of the bottom convex surface 57 underneath the speaker 55, and the utilization of slotted pillars 56 around the perimeter of this surface 57, the siren sound is reflected radially laterally through the spaces between the pillars 56 and radially distributed evenly in all directions. In this way, the alarm 45 produces a superior alert or warning signal (light and sound) that is independent of its directional orientation and natural elements.

Figure 2:
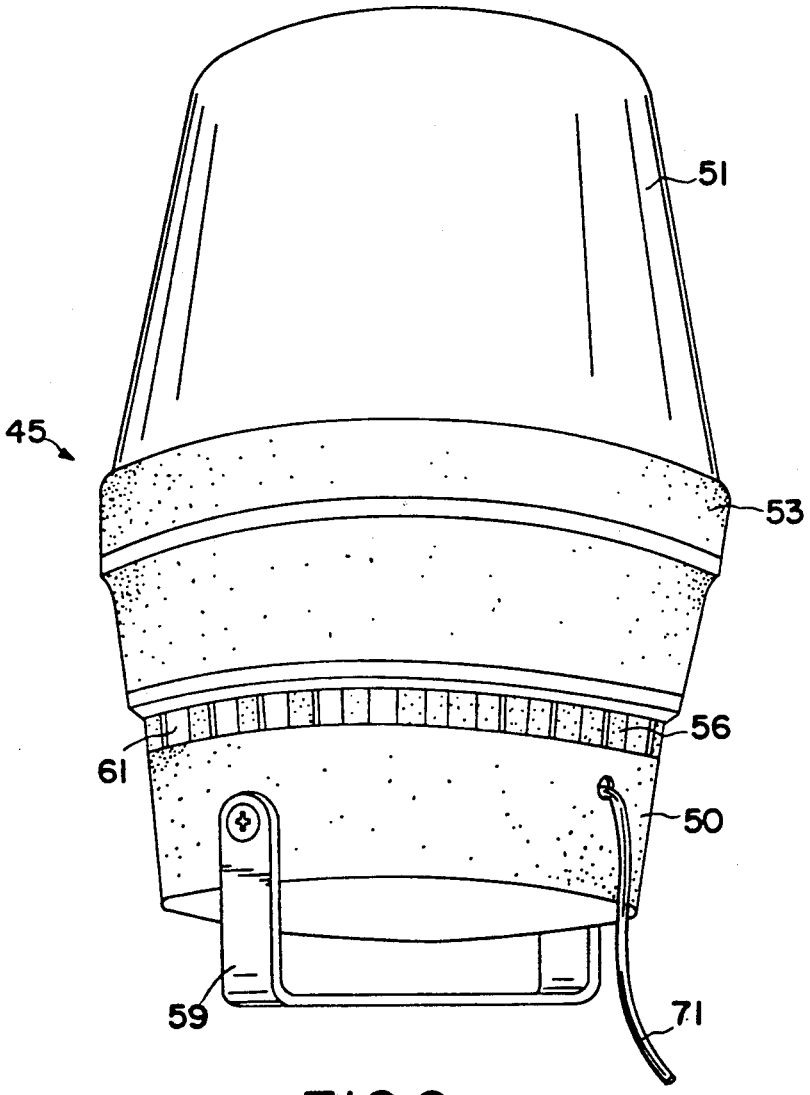
FIG. 2 represents a three dimensional illustration of the portable flashing light, sound alarm.

FIG. 2 shows a perspective view of the alarm 45. The screw mount lens 51 can be made of various transparent or translucent materials and can take on a different color to produce a prescribed effect. The slotted pillars 56 have two functions: they connect the mid-section 47 to the bottom section 48, and the vertical openings 61 between each pillar 56 facilitate even 360° distribution of siren sound in all directions. The power cord 71 connects the alarm 45 to a power source, while the bracket 59 provides flexibility by allowing installation on different objects.

Figure 3:
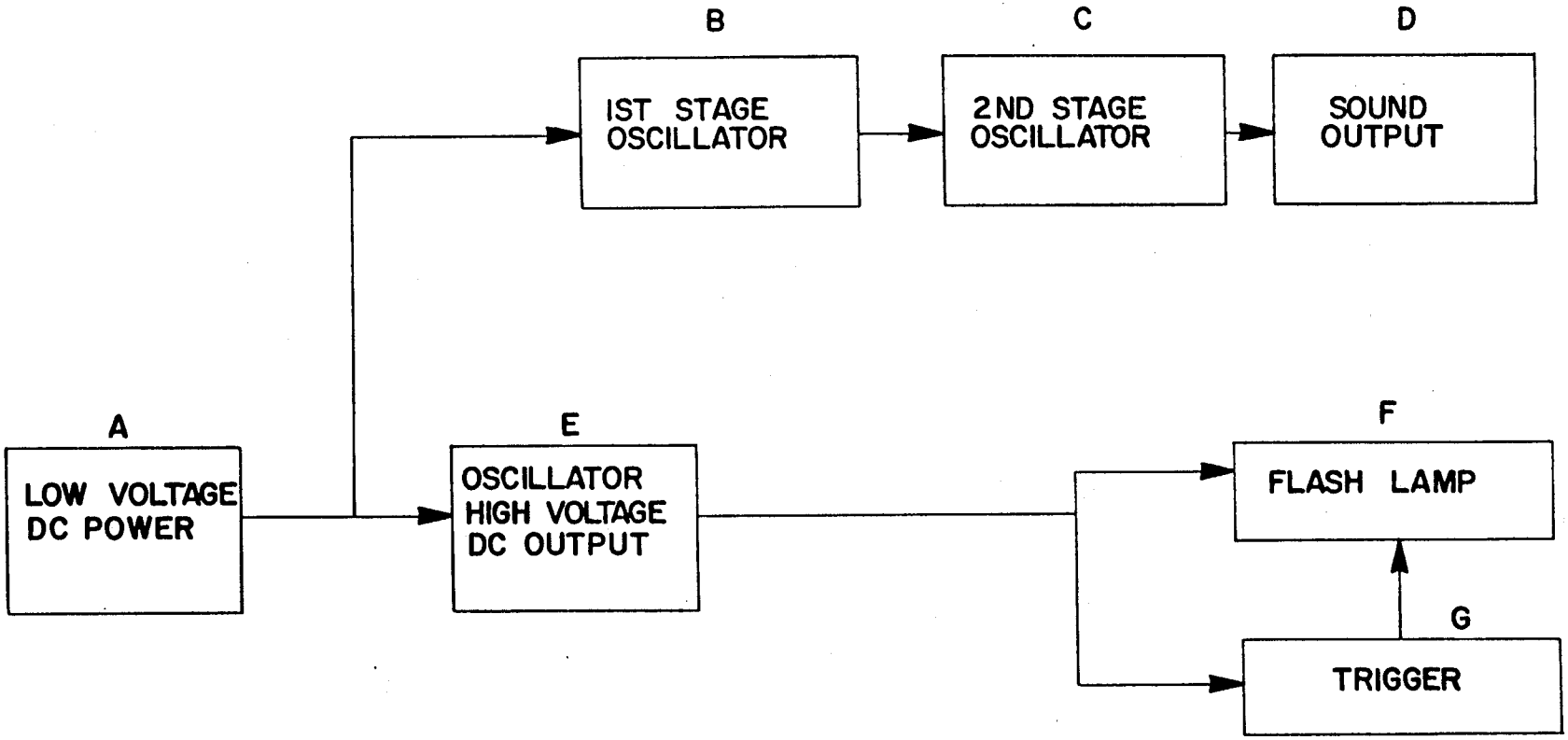
FIG. 3 illustrates a schematic block flow diagram of the electronic components of the portable flashing light, sound alarm.

FIG. 3 illustrates a schematic block-flow diagram of the electronic components of the alarm 45. Block A indicates a low voltage DC power source such as a lithium battery. The power from the battery 1 is split in one direction to a first stage oscillator B, a second stage oscillator C and then to a high pitch sound alarm D. The other half of the power split is to an oscillator E which converts the low voltage to high voltage. This in turn is connected to a flash lamp F, which can be a strobe light. The strobe light F can be activated by a trigger G (which can be a suitable on-off switch).

Figure 4:
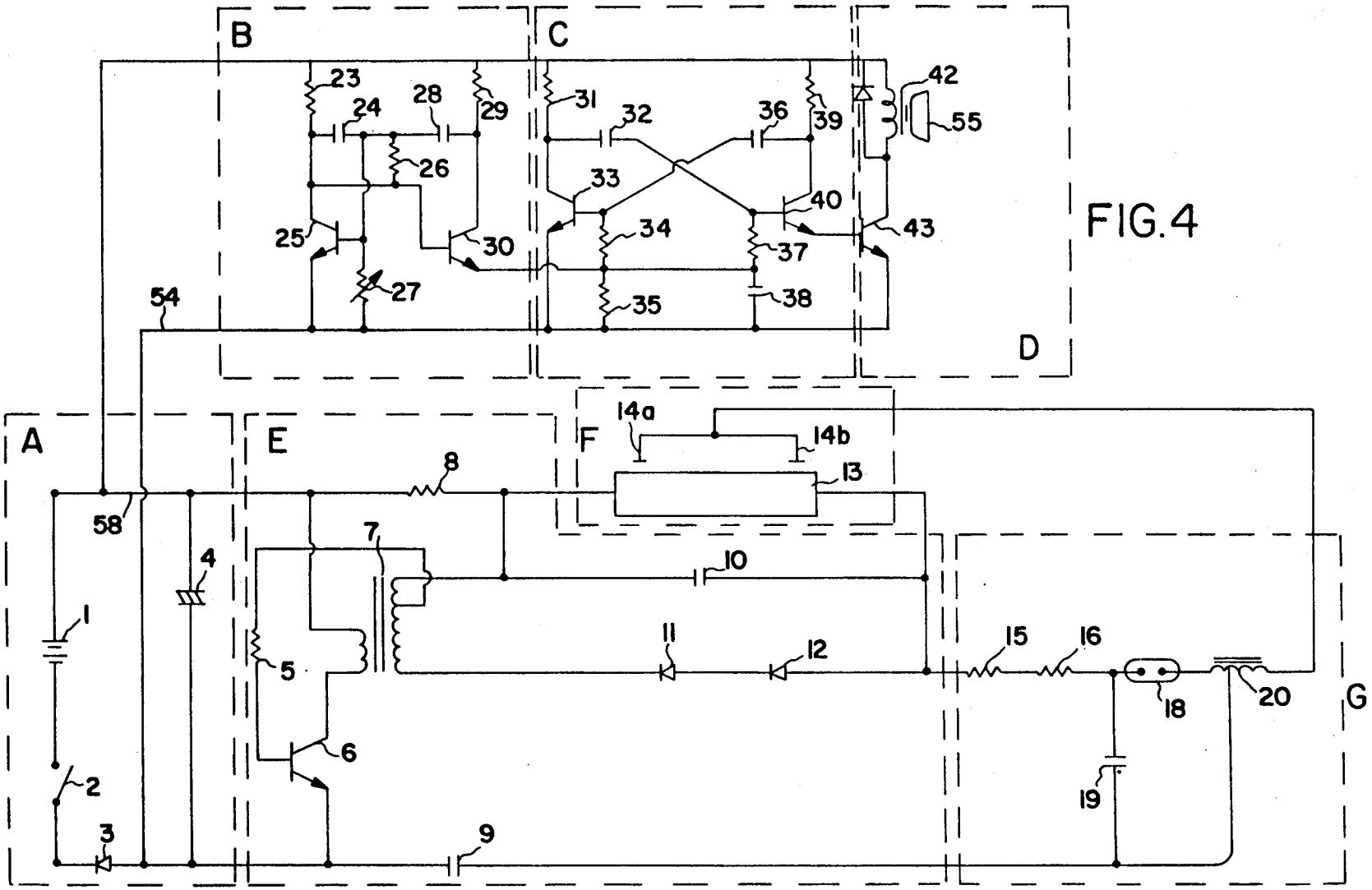
FIG. 4 depicts a circuit diagram of the electronics which drive the flashing light, sound alarm.

FIG. 4 shows the overall circuit of the system. The electronic circuit is divided into two parts 54 and 58. The various portions of the circuit diagram are outlined in lettered dotted-line areas to correspond with the lettered blocks shown in FIG. 3.

When switch 2 is closed, the battery 1 provides electric power to energize circuits 54 and 58. The capacitor 4 filters out the AC and stabilize the DC component of the voltage. Transformer 7, resistors 5 and 8 and transistor 6 together form an oscillator circuit to transform the small DC voltage into high voltage. On the high voltage side of the transformer 7 a tap is made through a resistor 5 to a transistor 6 as a positive feed back signal. The transformer 7 output signal passes through two series diodes 11 and 12 which filter out the negative voltage. The positive half of the voltage signal is applied across the capacitor 10. This causes the capacitor 10 to charge high voltage across the flash tube 13 (strobe light 52 in FIG. 1). When the capacitor circuit (consisting of resistors 15 and 16 and capacitor 19) is charged to a sufficient voltage, it causes discharge tube 18 to discharge. This signal is passed through the trigger coil 20 to two trigger electrodes **14*a* and 14*b* of flash tube 13**, thereby causing it to arc and flash.

When switch 2 is closed, the battery 1 not only powers the flash part of the circuit 58, but it also powers the siren circuit 54. The siren sound is produced by a two stage oscillator circuit B and C. The first stage B is comprised of resistors 23, 29, 26, and 27, capacitors 24 and 28, and transistors 25 and 30. The emitter of the transistor 30 produces a oscillating signal, whose frequency can be adjusted by resistor 27. The second stage of the oscillator circuit C is made up of resistors 31, 39, 34, 35, and 37, capacitors 32, 36, and 38, and transistors 33 and 40. When the output from the stage B is at the peak (maximum), the second stage oscillator circuit C produces a low frequency oscillating signal. When first stage output B is a low (minimum), the second stage oscillator circuit C produces a high frequency signal. The output from transistor 40 passes through transistor 43 and causes the speaker 55 to sound a loud siren alarm.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

I claim:

1. A flashing light siren alarm which comprises:

(a) a casing comprising three separable sections: an upper inverted cup-like transparent section which houses an electrical light emitting means; and inverted cup-like opaque mid-section which houses an electrical conical loud-speaker sound emitting means, the light emitting mean detachably secured to the top base of the mid-section; and an upright cup-like opaque lower section, the three sections being releasably connected together;

a mounting bracket attached to the outside of the lower section;

(c) an upwardly convex sound reflecting means positioned in the interior of the lower section below and in axial alignment with the electrical loud-speaker sound emitting means, and spaced from the loud-speaker to provide an even space between the periphery of the loud-speaker and the periphery of the sound reflecting means, the sound reflecting means being adapted to disperse the sound emitted by the loud-speaker sound emitting means horizontally and radially through 360° ;

(d) a battery housed in the lower section adapted to power the light emitting means and the sound emitting means; and (e) a plurality of spaced sound passing ports distributed 360° around the upper region of the lower section, the ports being disposed in horizontal alignment with the even space between the periphery of the convex sound reflecting means and the periphery of the loud-speaker sound emitting means.

2. An alarm as claimed in claim 1 wherein the sound reflecting means is a spherical upwardly convex surface which reflects sound emitted downwardly by the conical loud-speaker sound emitting means radially outwardly through the sound passing ports in the upper region of the lower section.

3. An alarm as claimed in claim 2 wherein the plurality of spaced sound passing ports are rectangular in shape and are spatially distributed in alignment around the circumference of the upper region of the lower-section of the casing.

4. An alarm as claimed in claim 3 wherein the loud-speaker is positioned in the interior of the open base of the mid-section and emits sound in a downwardly direction, the loud-speaker and the convex sound reflecting means being held in spaced parallel alignment with one another by the interconnection of the mid-section and the lower section.

5. An alarm as claimed in claim 1 wherein the battery is a DC electric power source which by actuation with an on-off switch means, powers an oscillator which in series drives and pulsates the light emitting means.

6. An alarm as claimed in claim 5 wherein the power source activates in series first and second oscillating means which drive the sound emitting means, the first oscillating means comprising a circuit of at least one resistor, at least one capacitor and at least one transistor, which co-operate to produce an oscillating signal, and the second oscillating means comprising a circuit of at least one resistor, at least one capacitor and at least one transistor which co-operate to produce an output which drives the sound emitting means.

7. An alarm as claimed in claim 6 wherein the output of the power source is passed through a transformer, at least one resistor, and at least one transistor, and a capacitor which builds up voltage to a level where it discharges and activates the light emitting means.

8. An alarm as claimed in claim 7 wherein the output of the capacitor is connected to a pair of trigger electrodes, which cause the light emitting means to flash.

* * * * *